United States Patent [19]

Knott

[11] Patent Number: 4,546,979

[45] Date of Patent: Oct. 15, 1985

[54] MOVABLE PIECE PUZZLE

[75] Inventor: Michael W. Knott, Twickenham, England

[73] Assignee: Kelrack Limited, Twickenham, England

[21] Appl. No.: 598,341

[22] PCT Filed: Jul. 8, 1983

[86] PCT No.: PCT/GB83/00169

§ 371 Date: Mar. 12, 1984

§ 102(e) Date: Mar. 12, 1984

[87] PCT Pub. No.: WO84/00308

PCT Pub. Date: Feb. 2, 1984

[30] Foreign Application Priority Data

Jul. 16, 1982 [GB] United Kingdom ..... 8220678

[51] Int. Cl.[4] ..... A63F 9/08

[52] U.S. Cl. ..... 273/153 S; 206/1.5

[58] Field of Search ..... 273/153 S; 206/1.5; 70/289, 290

[56] References Cited

U.S. PATENT DOCUMENTS

| | | | |
|---|---|---|---|
| 2,460,264 | 1/1949 | Prentice et al. | 273/280 X |
| 3,216,558 | 11/1965 | Marsh | 273/160 UX |

FOREIGN PATENT DOCUMENTS

| | | | |
|---|---|---|---|
| 81617 | 6/1983 | European Pat. Off. | 273/153 S |
| 592536 | 9/1947 | United Kingdom | 273/153 S |
| 591960 | 9/1947 | United Kingdom | 273/409 |

*Primary Examiner*—Anton O. Oechsle

*Attorney, Agent, or Firm*—Dennison, Meserole, Pollack & Scheiner

[57] ABSTRACT

A puzzle comprises a holder (1) defining a field of movement for rectangular pieces (5,6,7) which are slidable within said holder, the problem being to effect a sequence of displacements which will bring a key-piece (7) to a position at the opposite end of the holder (1). The key-piece can then be further moved to cause a portion (9) thereof to project out of the holder, through an aperture (8). The key-piece is in the form of a container for confectionery pieces or other objects which can be removed only by solving the puzzle and moving the key-piece (7) into said projecting position.

5 Claims, 3 Drawing Figures

MOVABLE PIECE PUZZLE

This invention relates to puzzles of a kind comprising one or more movable members and a holder defining an area within which such member(s) is (are) bodily displaceable in a given plane but so that a problem is involved in finding a sequence of displacements which will bring the or a particular member into a predetermined (hereafter called "home") position.

Some known puzzles of this kind are in the form of a maze. The holder supports a pattern of barrier walls within the field of movement of a movable member and the problem is to discover a route along which such member can move to reach the "home" position.

Other known puzzles of the kind referred to comprise a plurality of movable pieces assembled like pieces of a mosaic within a holder which leaves restricted free space, and the problem is to re-arrange the assembly by successive movements of pieces, to bring a given one of the pieces (hereafter called the "key-piece") to the "home" position. Such mosaic puzzles, like the maze puzzles above referred to, can obviously be of various degrees of difficulty. A mosaic puzzle which is very testing of patience and skill can be posed by apparatus comprising a holder which defines a rectangular field of movement for a plurality of pieces having in their plane of movement rectangular shapes of various sizes each of which is equal to or a multiple of a square module which is an aliquot portion of the said rectangular field, the free or uncovered area in the field being greater than the area of some but not all of the pieces. One piece can be larger than any of the others and such largest piece can be the key-piece which has to be brought to the "home" position. There may for example be at least four square pieces equal in size to the basic module, a number of rectangular pieces of length and breadth dimensions $2L \times 1L$ where L is the edge length of the basic module, and a single square component of edge length 2L. A particular example of such a puzzle is described in British Patent specification No. 592.536.

According to the present invention a puzzle of the kind referred to in the first paragraph of this specification incorporates or is associated with a container so that an exit mouth of the container via which contents of the container can be removed is free or freeable to allow passage of contents from the container only when the or a particular movable member has been brought into the "home" position.

The container of a device according to the invention can be used for example as a confectionery packaging device.

The puzzle of a device according to the invention can e.g. be of a maze or mosaic type as hereinbefore referred to.

In preferred embodiments of the invention the member whose displacement into the "home" position signifies successful solution of the puzzle is itself formed to serve as the container. Preferably the holder provides a support surface underlying the movable member(s) and the said displaceable member-cum-container is in the form of an inverted box whose mouth is closed by said support surface until such member is moved into the "home" position. Advantageously the said member has a step portion, i.e. a portion of reduced height, along one margin and the holder for the pieces provides in the vicinity of the "home" position a boundary wall aperture of sufficient height to allow such step portion to protrude therethrough. In these circumstances there need be no aperture in the said underlying support surface because contents of the displaceable member-cum-container can exit via the open bottom of the step portion when it is in that protruding position. As an alternative to that construction, the said underlying support surface can have an exit aperture with which an opening at the bottom of the said member/container registers when that member is in its "home" position. In such embodiments of the invention the puzzle is preferably of the mosaic type hereinbefore referred to, the container being formed by the key-piece. It is very satisfactory for example for the puzzle pieces to be rectanguloid pieces of various shapes in plan aspect e.g. as described in British patent specification No. 592.536 already mentioned.

In another embodiment of the invention the puzzle forms or forms part of the closure of an adjoining container. For example the mouth of the container may be covered by a plate over which the movable member(s) of the puzzle is (are) displaceable and which has a local exit aperture for the contents of the container, and the said displaceable member or a particular one of them if there is more than one, can have an aperture which registers with said aperture in the cover plate only when such member is in its "home" position. In such embodiments of the invention, the puzzle can be of a maze or mosaic type.

The movable member(s) of the puzzle may be retained in the plane of displacement by retaining means on the holder. In the case of a mosaic type puzzle the movable pieces can be retained by retaining means on the holder or in part by such means and in part by an inter-engagement of the pieces with each other e.g. as hereafter exemplified. Retaining means on the holder may e.g. comprise a top grid with open areas sufficient to allow access of a finger to the movable member(s), or marginal retaining lips extending inwardly from boundary or barrier walls of or in the field of movement of said member(s).

An embodiment of the invention, selected by way of example, is illustrated in the accompanying diagrammatic drawings, in which.

Figure 1:
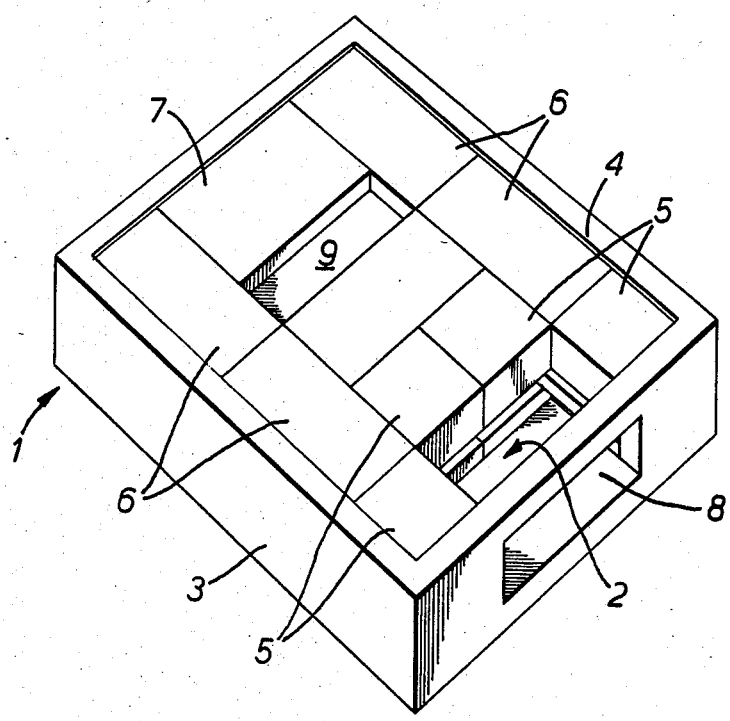
FIG. 1 is a perspective view of a puzzle-cum-container.

The puzzle comprises a holder 1 comprising a bottom wall 2 and a peripheral vertical wall 3 which forms a continous boundary of the field of movement of ten playing pieces which are slidable relative to each other within that field, subject to the restrictions imposed by that boundary wall and the limited area of the free space available within that field. A retaining lip 4 projects inwardly from the top of the vertical boundary wall 3 so as to overlie marginal portions of whatever playing pieces are for the time being against that wall.

Considering the playing pieces in plan aspect, there are four small square pieces 5, five rectangular pieces 6 each of which is twice the size of one of the small squares, and a large square piece 7 (the "key-piece") which is four times the size of a small square. The aggregate area of the playing pieces is accordingly equal to eighteen small squares. The field of movement defined by the holder is equal to twently small squares.

Figure 3:
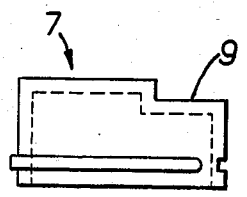
FIG. 3 is a side elevation of the largest playing piece, which is the key-piece.

To solve the puzzle sequential sliding movements of pieces 5–7 have to be made (usually only one piece can be moved a time) to bring the key-piece 7 into a position alongside and centrally of what in the aspect of FIG. 1 is the nearest side of the boundary wall 3 of the holder, at which position there is an aperture 8 in that wall. For convenience that side of the holder will be referred to as the front. As appears most clearly in FIG. 3, the key-piece has along one margin a portion of reduced height forming a step 9. This step is sufficiently shallow to be pushed through the said holder aperture 8.

All of the playing pieces are open at the bottom.

In other words they have the form of open-topped boxes which have been inverted. The key-piece 7 contains confectionary, and it is of course closed at the bottom by the bottom wall 2 of the holder. When the key-piece-cum-container 7 has been brought into a position alongside and opposite the aperture 8 it can then be pushed further forward to advance its step 9 through the slot 8. For this puzzle that advanced position is the "home" position. When the key-piece is in that "home" position confectionery can exit from the bottom of the step portion 9. The puzzle is of a convenient size for holding in one hand, the outside dimensions of the holder being, for example 88 mm×71 mm×18 mm. By placing the other hand beneath the step of the key piece as it advances through the aperture 8 and by advancing the step portion 9 only partly through the aperture 8, the user can if desired restrain the fall of confectionery pieces and allow only one or two pieces to escape. The pieces of the puzzle can of course be "re-shuffled" to prepare the puzzle for re-use with the playing pieces in their original start positions or in other start positions. The puzzle therefore has a continuing usefulness even if the key-piece-cum-container is empty. This piece can of course be re-filled with confectionery or other objects if so desired.

Figure 2:
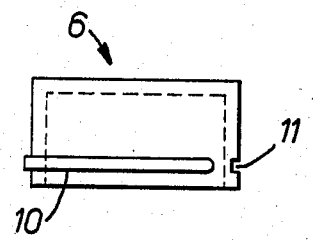
FIG. 2 is a side view of one of the elongate playing pieces.

Each of the playing pieces has a horizontal rib, such as the rib 10 of piece 6 shown in FIG. 2, which rib extends along the major part of each of two adjacent sides of the piece. A groove such as the groove 11 of piece 6 shown in FIG. 2 extends along the other two sides of each piece. The cross-sectional dimensions of the ribs and grooves are such that the ribs and grooves of adjacent faces of contiguous pieces inter-engage while allowing relative sliding motion of the pieces. Considering the puzzle in its FIG. 1 orientation, the north and west sides of each of the playing pieces carry the rib and the east and south sides of each component have the groove, and as all the pieces maintain their initial north-south orientation during use the situation never arises in which two grooved sides are together or two ribbed faces obstruct movement of two pieces alongside each other. The inter-engagement of the ribs and grooves, and the overlapping of the outer pieces by the retaining lip 4 on the holder combine to prevent the pieces from falling out of the holder if it is inverted.

It is very suitable for the holder and playing pieces of the illustrated puzzle to be plastics mouldings.

The illustrated puzzle-cum-container can be used as a packaging device for various objects and materials. In the confectionery field it is very suitable for use in retailing mints, which have a relatively long shelf-life.

By way of modification of the illustrated embodiment of the invention, the bottom wall 2 of the holder could be provided with an opening through which contents of the container-cum-key piece 7 can exit when the key piece is in a position alongside and centrally of the front side of the holder. In such an embodiment, that position of the key-piece is its "home" position and there is of course no need for the aperture 8. In a said modification, the container-cum-key-piece can have a bottom wall with a small local aperture and/or the opening in the bottom wall 2 of the holder can be smaller than the bottom area of the key-piece so that the passageway for the exit of objects from the container is relatively restricted.

As a further modification, the key-piece 7 can be made shallow enough to permit the entire key-piece to pass through the aperture 8 after the puzzle has been solved by bringing the key-piece into position alongside and in register with that aperture.

In any given embodiment of the invention the device, in addition to having said exit mouth which is freed by solving the puzzle, can be formed to enable contents of the container to be removed without solving the puzzle, should this for any reason be required. For example, in a puzzle-cum-container of the form represented in the accompanying drawings, the holder 1 can have one or more weakened zones to enable the bottom wall 2 or a portion thereof to be easily removed or broken so as to leave a bottom opening through which the contents of the container-cum-key piece 7 can escape. Such removable or breakable zone may for example be so located and be of such size that said bottom opening communicates with the interior of said piece 7 whatever be its position in the holder or only when that piece is in its illustrated initial position.

I claim:

1. A puzzle comprising a holder, at least one member retained within said holder for movement by hand solely in one plane within an area defined by said holder, a home position in said holder for selectively receiving said member upon movement thereof in said one plane, means in said holder for physically restricting freedom of movement of said member and requiring a sequence of movements to move said member to said home position when said member is within said holder and remote from said home position, said movable member being a container for material, said member having a materials exit mouth, said holder including means permitting discharge of material through said exit mouth solely when said container is in said home position.

2. A puzzle which comprises a holder with a displacement area defined therein, an assembly of pieces held within said displacement area for slidable movement in one plane within said displacement area, said displacement area restricting movement of said pieces and allowing shuffled movement of said pieces only by sequential sliding movements of different pieces, thereby defining a problem in determining a sequence of such movements which will bring a key piece to a predetermined home position in said area from a position remote from said home position, said assembly of pieces including said key piece in the form of a box for holding material, said key piece having a materials exit mouth and means on said holder preventing access to said exit mouth in any position other than said home position.

3. A puzzle according to claim 2, wherein said key piece contains confectionery.

4. A puzzle comprising a holder having a bottom wall defining a playing surface, and a peripheral wall rising from said playing surface and forming a continuous rectangular boundary to the playing surface of said bottom wall, a plurality of rectangular playing pieces of different sizes located on said playing surface and retained by said peripheral wall, said pieces being individually slidable over said playing surface for rearrangement into a variety of positions within the holder, said playing surface including a home position, one of said playing pieces being in the form of a box for holding material, said box-formed piece having a bottom outlet which is covered by said bottom wall of the holder in all positions other than said home position, said holder having, at the home position, an opening allowing discharge of material from the bottom outlet of said box-formed piece, the amount of space available on the playing field within said holder for the movements of said pieces being so limited relative to the size of the pieces as to require sequential sliding movements of a number of pieces to bring said box-formed piece to said home position from a position remote from said home position, thereby defining a problem involved in determining a sequence of movements which will achieve a home position for the box-formed piece.

5. A puzzle according to claim 4, wherein said box-formed piece includes a step portion of reduced height, said opening in said holder being defined in said peripheral wall in the vicinity of said home position, said opening being of sufficient height to allow such step portion to be advanced therethrough to allow discharge of material from said box-form piece.

* * * * *